US008465173B2

(12) United States Patent
Wang

(10) Patent No.: US 8,465,173 B2
(45) Date of Patent: Jun. 18, 2013

(54) LED LAMP AND STREET LAMP USING THE SAME

(75) Inventor: Zhen Wang, Beijing (CN)

(73) Assignee: Zhen Wang, Beijing (CN)

( * ) Notice: Subject to any disclaimer, the term of this patent is extended or adjusted under 35 U.S.C. 154(b) by 378 days.

(21) Appl. No.: 12/869,326

(22) Filed: Aug. 26, 2010

(65) Prior Publication Data

US 2011/0134638 A1 Jun. 9, 2011

Related U.S. Application Data

(63) Continuation-in-part of application No. 12/678,866, filed as application No. PCT/CN2009/075830 on Dec. 22, 2009.

(30) Foreign Application Priority Data

Dec. 7, 2009 (CN) ..... 2009 1 0224095

(51) Int. Cl.
*F21V 7/00* (2006.01)

(52) U.S. Cl.
USPC ..... 362/247; 362/297

(58) Field of Classification Search
USPC ..... 362/247, 297, 294
See application file for complete search history.

(56) References Cited

U.S. PATENT DOCUMENTS

| | | | | |
|---|---|---|---|---|
| 6,019,493 | A * | 2/2000 | Kuo et al. | 362/335 |
| 2006/0061990 | A1 * | 3/2006 | Chinniah et al. | 362/247 |
| 2009/0052191 | A1 * | 2/2009 | Wang | 362/307 |

* cited by examiner

*Primary Examiner* — Anh Mai
*Assistant Examiner* — Elmito Breval
(74) *Attorney, Agent, or Firm* — Birch, Stewart, Kolasch & Birch, LLP

(57) ABSTRACT

A light-emitting diode (LED) lamp and a street lamp using the same are provided. The LED lamp includes substrates for mounting LEDs, reflectors, radiators, a mounting frame, a power source, and a top cover. The substrates and the reflectors are mounted on the radiators. Each of the substrates has a condenser cup mounted around a light-emitting surface of the LED, and the condenser cup has a curved wall for condensing light rays emitted by the LED to a certain angle range; each of the reflectors has a curved surface for performing a second time reflection condensing on the light rays that are processed through the reflection condensing by the curved wall. The LED lamp realizes uniform lighting in the whole lighting range through performing reflection twice, thereby achieving excellent directivity of illumination, uniform brightness, eliminating the glare phenomenon, and achieving desirable heat dissipation performance.

7 Claims, 3 Drawing Sheets

LED LAMP AND STREET LAMP USING THE SAME

This application is a Continuation-In-Part of copending application Ser. No. 12/678,866 filed on Mar. 18, 2010. Application Ser. No. 12/678,866 is the national phase of PCT International Application No. PCT/CN2009/075830 filed on Dec. 22, 2009, and claims priority under 35 U.S.C. §119(a) to Patent Application No. 200910224095.4 filed in China, on Dec. 7, 2009, all of which are hereby expressly incorporated by reference into the present application.

BACKGROUND OF THE INVENTION

1. Field of Invention

The present invention relates to a light-emitting diode (LED) lamp and a street lamp using the same, which belongs to the field of lighting technology.

2. Related Art

In the wide areas of outdoor roads and squares, conventional lighting lamps are high-pressure sodium lamps or metal halide lamps. The high-pressure sodium lamps or metal halide lamps have a luminous efficiency of 60-80 μm/W, and have a service life of about 6000 hours (h). Currently, the LED lamps have a luminous efficiency of 100-120 μm/W, and have a service life of up to over 25000 h, and do not contain hazardous metal mercury. With the development of semiconductor technologies, such performance of the lamps has been increasingly enhanced. Thus, in recent years, energy-saving and environment-friendly LED lighting lamps have gradually become popular in the market.

The existing LED lighting lamps mainly have two implementations: one is placing an LED light source (briefly referred to as LED) within a conventional lamp; the other is laying out LEDs uniformly, and using a partial reflector or a partial lens for controlling the light. Unfortunately, the above two implementations still cannot overcome the defects of the conventional lighting lamps as follows. Firstly, the directivity of the illumination is poor. The regionality of the illumination is not obvious, that is to say, the lamp illuminates undesirable regions. Thus, in the case of providing the same luminous flux, the brightness of the region requiring the illumination is decreased. Secondly, the brightness is non-uniform, which results in a phenomenon of being bright at a close area and being dark at a distant area. As a result, the luminance of the distance area cannot reach the standard level, or the luminance of the close area is far beyond the standard level. Due to the non-uniform distribution of the illumination, a light source with a higher power and a higher luminous flux has to be adopted in design, so as to enable dark areas at both sides of the road and between two lamps reach the lighting standard level, thereby meeting the luminance requirements of the dark areas, which results in wastes of electric energy. Thirdly, the glare phenomenon cannot be eliminated. The so-called glare phenomenon refers to that when people observe a certain visual object, a dazzling light-emitting spot existing in the visual field may affect the observing effect, which makes people feel uncomfortable. Fourthly, the heat-dissipation problem is not well solved. Currently, about more than 80% of the energy consumption of the LEDs is converted into heat energy, and the semiconductor elements are not high temperature resistant. A lot of LEDs are concentrated in a relative small space, and the continuously increased heat makes the temperature of the LED chip become excessively high. If the generated heat energy cannot be dissipated timely, the luminous efficiency and the service life of the LED may be severely decreased under a high temperature. In most of the existing LED lamps, radiators are disposed horizontally, which have a poor heat convection effect.

The basic reasons for causing the above defects include that, the prior art cannot make full use of the directionality of LEDs, cannot effectively and reasonably control the light rays generated by the LEDs, and cannot effectively dissipate the heats for the LED lamps.

SUMMARY OF THE INVENTION

Accordingly, the present invention is directed to a novel LED lamp, which has excellent directivity of illumination, uniform brightness, can eliminate the glare phenomenon, and has desirable heat dissipation performance.

The present invention is further directed to a street lamp using the LED lamp.

In order to achieve the above objectives, the present invention adopts the following technical solutions.

An LED lamp is provided, which includes substrates for mounting LEDs, reflectors, radiators, a mounting frame, a power source, and a top cover, and the substrates and the reflectors are mounted on the radiators.

Each of the substrates has a condenser cup mounted around a light-emitting surface of the LED, and the condenser cup has a curved wall for condensing light rays emitted by the LED to a certain angle range through performing reflection condensing for a first time.

Each of the reflectors has a curved surface for performing a second time reflection condensing on the light rays that are processed through the reflection condensing by the curved wall.

Each of the radiators has a plurality of heat dissipation fins arranged in a horizontal direction, in which the heat dissipation fins extend along a direction perpendicular to the ground surface.

The curved wall has a shape for condensing the light rays emitted by the LED to a range of 0 degree to a degrees, in which $\alpha$ is any angle smaller than 60 degrees.

A lower end of the curved wall reflects incident light rays emitted by the LED into light rays having an included angle of $\alpha$ degrees with respect to the line of zero degree; an upper end of the curved wall reflects incident light rays emitted by the LED that are larger than or equal to a degrees into light rays parallel to the line of zero degree.

The curved surface of each of the reflectors has a vertical curvature for reflecting light rays from a plurality of LEDs along a vertical direction into a first predetermined range, and in the first predetermined range, a ratio of the number of LEDs distributed in each position to the number of LEDs along the vertical direction is in direct proportion to a square of a distance from the position to the LED.

The curved surface of each of the reflectors has a horizontal curvature for reflecting light rays from a plurality of LEDs along a horizontal direction into a second predetermined range, and in the second predetermined range, a ratio of the number of LEDs distributed in each position to the number of LEDs along the horizontal direction is in direct proportion to a square of a distance from the position to the LED.

Two substrates, two reflectors, and two radiators exist, which are symmetrically mounted on two sides of the LED lamp, and the radiators are mounted at an outer side, the substrates are mounted in the middle, and the reflectors are mounted at an inner side.

Alternatively, an LED lamp forming a light distribution mode of an approximate parallel optical array by using lenses is provided, which includes substrates for mounting LEDs, reflectors, a power source, and a top cover.

A condenser lens is mounted in front of each of the LEDs, and the condenser lenses are used for converging beam angles of the LEDs.

The plurality of LEDs is arranged in a matrix to form the approximate parallel optical array.

The reflectors each have a curved surface for performing reflection and light controlling on light rays reflected and controlled by a curved wall.

A street lamp is further provided, and the street lamp uses the LED lamp as defined above.

The LED lamp provided in the present invention has excellent directivity of illumination, uniform brightness, can eliminate the glare phenomenon, and has desirable heat dissipation performance. In addition, the LED lamp has various advantages of a simple structure, being conveniently mounted, energy-saving, environmental friendly, and so on.

BRIEF DESCRIPTION OF THE DRAWINGS

The present invention is further described below with reference to the accompanying drawings and specific embodiments.

DETAILED DESCRIPTION OF THE INVENTION

Figure 1:
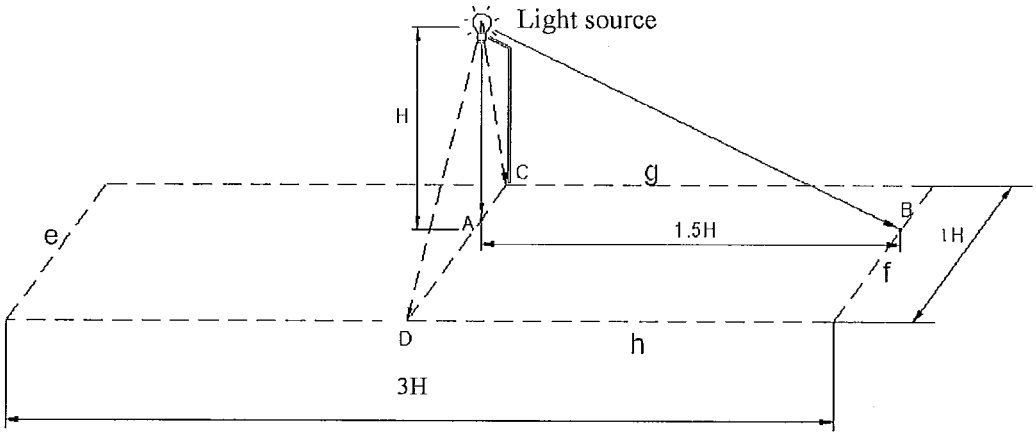
FIG. 1 is a schematic view of a street lamp using an LED lamp according to the present invention.

As shown in FIG. 1, an LED lamp provided in the present invention is mounted on a street lamp with a height of H meters (m) (H is a natural number, which is the same below), for road lighting. It should be understood that, the LED lamp of the present invention may also be mounted in other indoor or outdoor lighting devices, for example, court lamps, square lamps, or landscape lamps. The street lamp is taken as an example below for demonstrating the structure of the LED lamp provided according to the present invention.

Referring to FIG. 1, a lighting range of each street lamp is a range having a length of 3.0H m along a length direction of the road (that is, an initial position is a line segment e, and a terminating position is a line segment f) and having a length of 1H m along a width direction (that is, an initial position is a line segment g, and a terminating position is a line segment h) with the street lamp as a center. The LED lamp is symmetric at left and right sides along the length direction of the road, so that the left side part of the street lamp is omitted here, and merely the right side part of the street lamp is discussed, that is, the range being 1.5H m long and 1H m wide on the right side of the street lamp along the length direction of the road. The attenuation of light rays is in direct proportion to a square of an illumination distance. Under the same illumination intensity, the farther away from the center of the light source of the street lamp, the smaller the brightness will be. It is assumed that a brightness of a near point A (which seems to be approximately the location of the street lamp) right under the LED lamp is 1 unit, so that a far point B 1.5H m away from the street lamp has a brightness of about 0.33 units. In order to enable the Point A and the Point B to have the same brightness, the luminous flux (illumination intensity) three times as much as that of the near point A is required at the far point B. Similarly, the illumination intensity of any point within the lighting range of the LED lamp can be acquired. In order to realize the uniform distribution of the illumination intensity within the lighting range, the light rays with the illumination intensity needs to be distributed on the light source, that is, the LED lamp, according to the lighting distance, and the light rays are reflected to the designated regions along a certain direction, so that the light rays are effectively controlled to be uniformly emitted to the required regions.

In order to meet the above requirements, in a first embodiment of the present invention, the LED lamp of the present invention changes the divergence angle of the light source through performing reflection condensing for a first time and then realizes the required light controlling effects through performing the reflection condensing for a second time according to the directionality of the LED. In a second embodiment of the present invention, the LED lamp of the present invention changes the divergence angle of the light source to form an approximate parallel optical array through performing condensing for a first time with a lens, and then realizes the required light controlling effects through performing reflection condensing for a second time according to the directionality of the LED.

Figure 2:
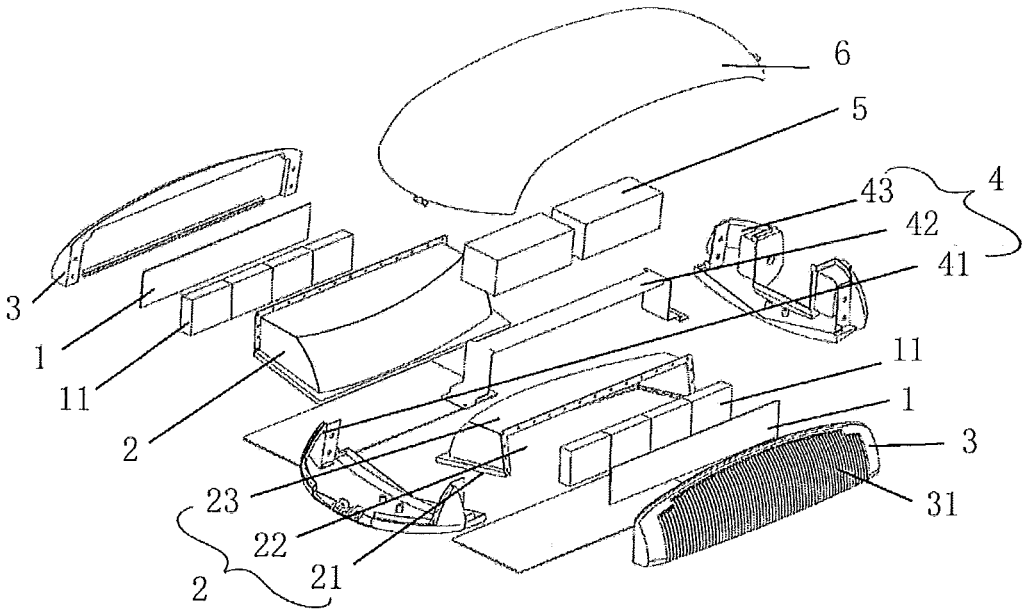
FIG. 2 is a schematic structural view of an LED lamp according to the present invention.
Figure 3:
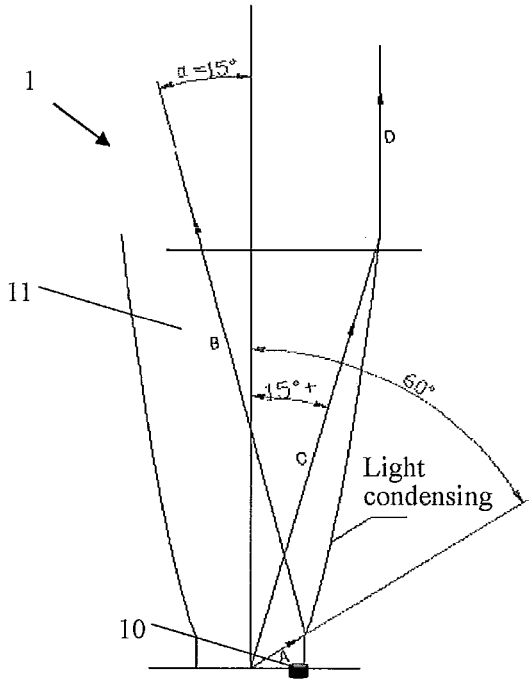
FIG. 3 is a schematic structural view of a condenser cup of the LED lamp shown in FIG. 2.
Figure 6:
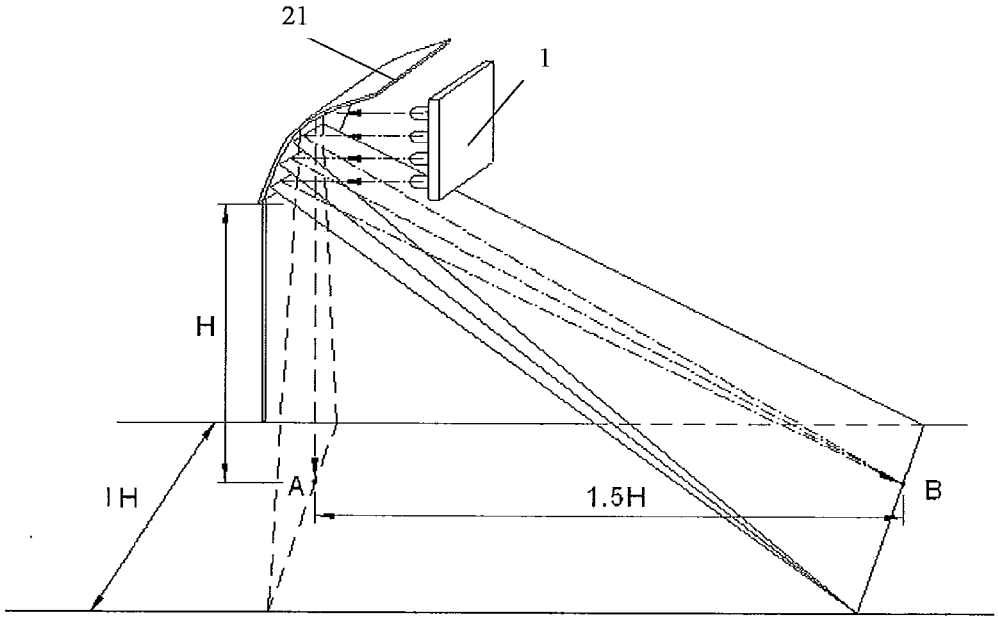
FIG. 6 is an enlarged schematic structural view of a reflector of the LED lamp shown in FIG. 2.

Referring to FIGS. 2, 3, and 6, the LED lamp according to the first embodiment of the present invention is further described below in detail.

Referring to FIG. 2, the LED lamp of the present invention includes substrates 1, reflectors 2, radiators 3, a mounting frame 4, a power source 5, and a top cover 6. Each of the substrates 1 further includes a condenser cup 11, and the mounting frame 4 further includes a front caulking 41, a retaining plate 42, and a rear caulking 43.

Referring to FIG. 3, a plurality of LEDs 10 is mounted and arranged on the substrate 1, and the condenser cup 11 is provided outside each of the LEDs 10. The condenser cup 11 may be separated from the substrate 1, or may be integrated with the substrate 1 in structure. An inner wall (that is, a curved wall) of the condenser cup 11 is designed to condense light rays emitted by the LED 10 to light rays with a beam angle falling within a certain range. The condensing principle of the condenser cup 11 is described below in detail.

Each of the reflectors 2 has a box-like overall shape, and has certain rigidity and stability itself. The reflector 2 includes a curved surface 21, a positioning mounting hole 22, and a light exit opening 23 for emitting the light rays, after being reflected by the reflector 2, to the exterior. The positioning mounting hole 22 and the light exit opening 23 are respectively located at two sides of the curved surface 21. The positioning mounting hole 22 is disposed at an edge of the reflector 2, and is used for directly connecting to the substrate 1, so as to effectively ensure the position precision of the substrate 1, thereby ensuring that the position on the reflector 2 where the light emitted from the light source LED 10 reaches does not bias.

The curvature of the curved surface 21 is determined according to the required lighting range and light control requirements on the uniform illumination for the LED lamp. Specifically, the curved surface 21 has a vertical curvature for reflecting light rays emitted by M LEDs along a quasi-vertical direction into a range from the near point A in the length direction of the road to the far point B in the length direction of the road, in which a ratio of the number of LEDs distributed to each position corresponding to the length direction of the road to the total number (that is, M) of LEDs along the quasi-vertical direction is in direct proportion to a square of a distance from the position to the LED. Similarly, the curved surface 21 has a horizontal curvature for reflecting light rays emitted by N LEDs along a quasi-horizontal direction into a range from a near point C in the width direction of the road to a far point D in the width direction of the road, in which a ratio of the number of LEDs distributed to each position corresponding to the width direction of the road to the total number (that is, N) of LEDs in the quasi-horizontal direction is in direct proportion to a square of a distance from the position to the LED. The above vertical curvature and horizontal curvature may be acquired through calculations according to the fundamental principle in the geometrical optics, which will not be further described here in detail. M and N are natural numbers, and the magnitudes of M and N are required to meet the light control precision requirements and the brightness requirements.

Taking FIG. 6 for example, it is assumed that the LED lamp needs to illuminate the range from the Point A to the Point B, and the reflector 2 needs to reflect light rays emitted by 4n LEDs (n is a natural number, which is the same below) connected in series. As mentioned above, in order to enable the Point A and the Point B to have the same brightness, the illumination intensity three times as much as that of the near point A is required at the far point B. Thus, the curved surface 21 reflects light rays emitted by the highest n LEDs to the Point A, and reflects light rays emitted by the other 3n LEDs to the Point B. Therefore, in one aspect, the light rays are ensured to cover the whole region from the Point A to the Point B, without illuminating any other undesirable region, thereby ensuring the desirable directionality of illumination; in another aspect, it is ensured that the illumination intensity at the Point B is the same as that of the Point A, that is, the brightness is uniform across the whole lighting range.

Each of the radiators 3 also achieves a supporting function. Each of the radiators 3 has a plurality of heat dissipation fins 31 arranged in a horizontal direction. The heat dissipation fins 31 extend along a direction perpendicular to the ground surface. After the air surrounding the radiator 3 is heated, the density of the air is reduced, so that the air rises upwards. The heat dissipation fins 31 in the radiator 3 are arranged along a direction consistent with the rising direction of the air, so that the circulating path is short, the heat convection is fast, and the heat dissipation efficiency is quite high.

The front caulking 41 on the mounting frame 4 is used for mounting the retaining plate 42, as well as for decoration. The retaining plate 42 is used for mounting the power source 5. The rear caulking 43 achieves a supporting function. In one aspect, the rear caulking 43 is used for cooperating with the front caulking 41 to mount the retaining plate 42, and in another aspect, the rear caulking 43 is used for mounting two reflecting enclosure members (further described later) symmetric on the left and right sides through the radiator 3. The LED lamp is mounted on a lamp post through a lamp post connecting mechanism on the rear caulking 43.

In the LED lamp of the present invention, the condenser cups 11 are mounted around illumination surfaces of the LEDs 10, and then the substrates 1 and the condenser cups 11 are mounted on the radiators 3, which are then assembled into the reflecting enclosure members together with the reflectors 2 and light transmissive plates. The two reflective enclosure members are symmetrically mounted on the rear caulking 43 through their respective radiators. The front caulking is mounted on the two radiators symmetric on the left and right sides through mounting holes at two sides thereof respectively. The retaining plate 42 is mounted on the front caulking and the rear caulking. That is, two substrates 1, two reflectors 2, and two radiators 3 exist, which are symmetrically mounted on the rear caulking 43 through the radiators. The substrates 1 are mounted at an outer side of the reflectors 2, and the radiators 3 are mounted at an outer side of the substrates 1. The power source 5 is configured at a middle position above the retaining plate 42, and the top cover 6 covers the power source 5. Through the above design solution, the LED lamp of the present invention has a simple overall structure and a reasonable heat dissipation structure, and further has a circular-arc-shaped external appearance transition, which thus has a small windward surface, thereby being more reasonable during the application in the actual environment.

Figure 4:
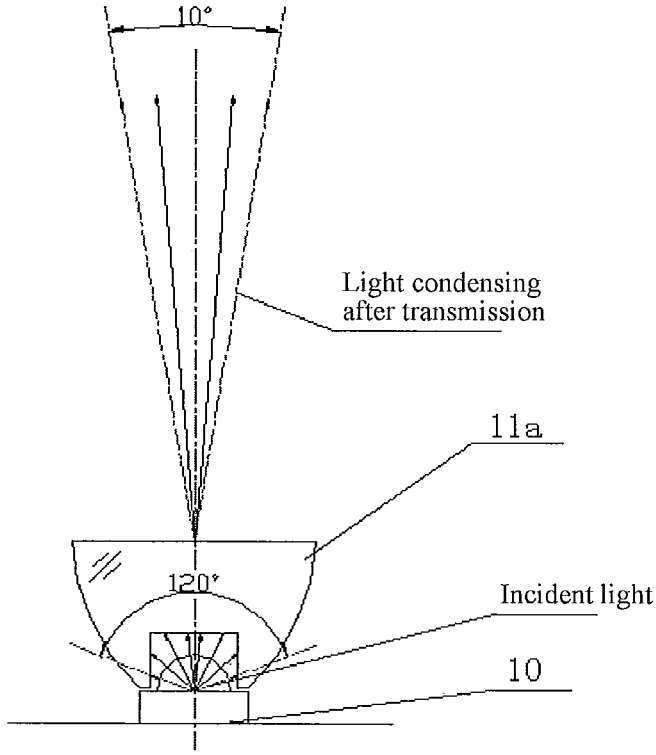
FIG. 4 is a schematic view of mounting a condenser lens in the LED lamp shown in FIG. 2.
Figure 5:
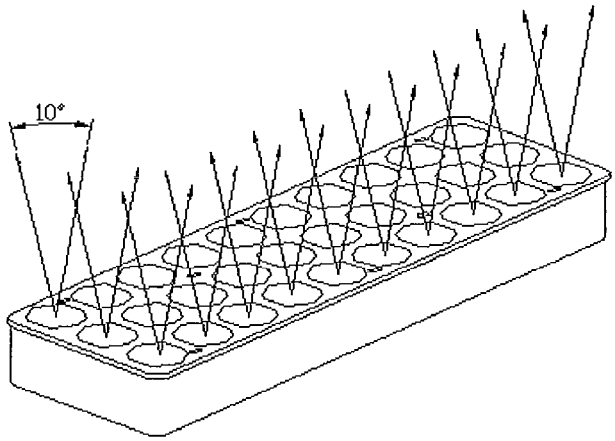
FIG. 5 is a schematic view of a parallel optical array formed by a plurality of LEDs and the condenser lenses.

Referring to FIGS. 4 and 5, the LED lamp according to the second embodiment of the present invention is further described below in detail.

Referring to FIG. 4, a plurality of LEDs 10 is arranged on a substrate 1, and each LED 10 has a condenser lens 11*a* mounted on a front end thereof. The condenser lens 11*a* is preferably a cone-shaped or cup-shaped catadioptric lens, which is capable of performing transmission condensing right ahead, and a conical surface may collect all the side light and reflect the side light out, such that the overlapping of the two kinds of light (having the same angle) may obtain the perfect light ray utilization and desired light spot effect. The use of the condenser lens 11*a* may converge light emitting angles of the LED light sources, for example, a beam angle of an LED light source is about 120 degrees, and after passing through the condenser lens 11*a*, the beam angle may be converged to about 10 degrees.

In practice, the condenser lens 11*a* may be made of silica gel, optical grade polymethylmethacrylate (PMMA), optical grade polycarbonate (PC), and glass. Taking the outdoor street lamp being irradiated by ultraviolet radiation, light transmittance, and easy production into consideration, the condenser lens 11*a* is preferably made of optical grade PC. However, other materials are also available according to actual demands.

As shown in FIG. 5, in order to make the LED lamp to generate parallel light with preferred directivity, a plurality of LEDs 10 may be arranged in a matrix to form a parallel optical array. By using this parallel optical array, diverging light having large angle may be irradiated to the reflector 2 in a light distribution mode approximate to parallel light, and then the reflector 2 performs precise light controlling.

In the LED lamp of the present invention, the condenser lenses 11*a* are mounted at the front end of the LEDs 10, the substrates 1 and the condenser lenses 11*a* are mounted on the radiators 3, which are then assembled into the reflecting enclosure members together with the reflectors 2 and light transmissive plates. The two reflective enclosure members are symmetrically mounted on the rear caulking 43 through their respective radiators. The front caulking is mounted on the two radiators symmetric on the left and right sides through mounting holes at two sides thereof respectively. The retaining plate 42 is mounted on the front caulking and the rear caulking. That is, two substrates 1, two reflectors 2, and two radiators 3 exist, which are symmetrically mounted on the rear caulking 43 through the radiators. The substrates 1 are mounted at an outer side of the reflectors 2, and the radiators 3 are mounted at an outer side of the substrates 1. The power source 5 is configured at a middle position above the retaining plate 42, and the top cover 6 covers the power source 5. Through the above design solution, the LED lamp of the present invention has a simple overall structure and a reasonable heat dissipation structure, and further has a circular-arc-shaped external appearance transition, which thus has a small windward surface, thereby being more reasonable during the application in the actual environment.

The working principles of the condenser cups 11 and the reflectors 2 are further described below.

Generally, the beam angle range of the LEDs is 90 degrees to 120 degrees (taking the line of zero degree as an axis of symmetric). The luminous flux mainly focuses on 0 degree to 60 degrees, and the luminous flux exceeding 60 degrees is rather small, which may be omitted, so that merely the range of 0 degree to 60 degrees is discussed here. As for the LEDs, the luminous flux in a certain angle range approaching 0 degree is much greater than that in the same angle range approaching 60 degrees. For example, the luminous flux in the 0 degree to 15 degrees takes about 50% of the total luminous flux (luminous flux in the 0 degree to 60 degrees), and the luminous flux in the range of 45 degrees to 60 degrees merely takes 15% of the total luminous flux. Based on such a characteristic, in the LED lamp of the present invention, it is assumed that the light in the range of 0-$\alpha$ degrees falls within the range of direct illumination, without requiring reflection control; but the light in the range of $\alpha$-60 degrees requires reflection control, so that the light in this range does not exit directly along the original direction, but exit along the direction of 0-$\alpha$ degrees, thereby achieving the condensing effects. Such reflection condensing process is accomplished by the condenser cups 11.

At least a part of the inner wall of the condenser cup 11 is a curved wall. The light rays in the range of $\alpha$-60 degrees are totally emitted to the curved wall of the condenser cup 11. A lower end of the curved wall reflects incident light rays (indicated by a line A in FIG. 3) of 60 degrees emitted by the LED 10, and emits the light rays along a reflection path B, in which an included angle between the line B and the line of zero degree is a degrees ($\alpha$ is any angle smaller than 60 degrees). An upper end of the curved wall reflects incident light rays C emitted by the LED 10 that are larger than or equal to a degrees, and emits the light rays along a reflection path D, in which the line D is almost parallel to the line of zero degree. Similarly, a middle part of the curved wall reflects light falling between 60 degrees and a degrees emitted by the LED 10, and emits the light along a direction between a degrees and 0 degree. In this way, the incident light rays in the range of $\alpha$-60 degrees are reflected by the condenser cup 11 and then emitted in the range of 0-$\alpha$ degrees, so that the light rays in the range of 0-60 degrees are controlled into light rays in the range of 0-$\alpha$ degrees, thereby achieving the effects of converging the divergent light rays. Thus, the condenser cup 11 realizes the reflection condensing for the first time.

The light from the condenser cup 11 (or the condenser lens 11*a*) is completely emitted to the whole reflection curved surface of the reflector 2, thereby realizing accurate light control effects. The reflector 2 is used for realizing the reflection condensing for a second time. As shown in FIG. 6, the light rays emitted by the highest LEDs are condensed by the condenser cup 11 (or the condenser lens 11*a*), and are emitted to the curved surface 21 of the reflector 2. It is assumed that the luminous flux of each LED is A. The light rays from n LEDs are reflected by the corresponding regions on the reflector 2 and then reach the Point A (a distance to the LED is H), and the illumination intensity is $k \cdot nA/H^2$ (k is a proportion coefficient). The light rays from 3n LEDs are reflected by the corresponding regions on the reflector, and then reach the Point B (a distance to the LED is 1.5H), and the illumination intensity is $k \cdot (3\ nA)/[H^2+(1.5H)^2] \approx k \cdot nA/H^2$. Thus, the light intensity at the Point A and the Point B are the same. Similarly, the number of LEDs is distributed between the Point A and the Point B according to the above principle, so as to ensure the same light intensity at any position along the AB direction (a length direction of the road). Similarly, the same light intensity can be ensured at any position in the width direction of the road, thereby achieving the uniform illumination effects in a certain region.

The inner wall of the condenser cup 11 is quite smooth, and has a high reflectance, so that the attenuation of the light is quite small. In addition, since no direct illumination of the light and no dramatic change of the brightness occurs, and the light control angle design of the reflectors 2 is utilized, the LED lamp of the present invention eliminates the unreasonable glare phenomenon, and satisfies the requirements of the using effects in the illumination environment, thereby having wide application prospects in the indoor and outdoor lighting.

The LED lamp and the street lamp using the same according to the present invention have been described above in detail. Any person skilled in the art who makes obvious modification on the present invention without departing from the substantial sprints of the present invention may be construed as infringing the patent rights of the present invention patent, so as to undertake the corresponding legal responsibility.

What is claimed is:

1. A light-emitting diode (LED) lamp, comprising:

substrates for mounting LEDs, reflectors, a power source, and a top cover, wherein, a condenser lens is mounted at a front end of each of the LEDs, and the condenser lenses are used for converging beam angles of the LEDs;

the plurality of LEDs is arranged in a matrix to form an approximate parallel optical array; and the reflectors each have a curved surface for performing reflection and light controlling on light rays reflected and controlled by a curved wall.

2. The LED lamp as defined in claim 1, wherein, the LED lamp further comprises:

radiators, each of the radiators has a plurality of heat dissipation fins arranged in a horizontal direction, and the heat dissipation fins extend along a direction perpendicular to a ground surface.

3. The LED lamp as defined in claim 2, wherein, the substrates and the reflectors are mounted on the radiators.

4. The LED lamp as defined in claim 3, wherein the substrates include first and second substrates, and the reflectors include first and second reflectors, and further comprising:

first and second radiators, wherein the first substrate, the first reflector and the first radiator are mounted on a first side of the LED lamp, and the second substrate, the second reflector and the second radiator are mounted on a second side of the LED lamp opposite to the first side; and the first and second radiators are mounted at opposite outer sides of the LED lamp, the first and second reflectors are mounted at opposite inner sides of the LED lamp, the first substrate is mounted between the first radiator and the first reflector on the first side of the LED lamp, and the second substrate is mounted between the second radiator and the second reflector on the second side of the LED lamp.

5. The LED lamp as defined in claim 1, wherein the curved surface of each of the reflectors has a vertical curvature for reflecting light rays from a plurality of LEDs along a vertical direction into a first predetermined range, and in the first predetermined range, a ratio of a number of LEDs distributed in each position to a number of the LEDs along the vertical direction is in direct proportion to a square of a distance from the position to the LED.

6. The LED lamp as defined in claim 1, wherein the curved surface of each of the reflectors has a horizontal curvature for reflecting light rays from a plurality of LEDs along a horizontal direction into a second predetermined range, and in the second predetermined range, a ratio of a number of LEDs distributed in each position to a number of the LEDs along the horizontal direction is in direct proportion to a square of a distance from the position to the LED.

7. A street lamp, wherein the street lamp using the LED lamp as defined in claim 1.

* * * * *